US011315524B2

(12) United States Patent
An et al.

(10) Patent No.: US 11,315,524 B2
(45) Date of Patent: Apr. 26, 2022

(54) DISPLAY DEVICE AND METHOD FOR RESTORING DETERIORATION DATA OF THE SAME

(71) Applicant: SAMSUNG DISPLAY CO., LTD., Yongin-si (KR)

(72) Inventors: Byoung Kwan An, Yongin-si (KR); Sang Myeon Han, Yongin-si (KR); Joon Hyeok Jeon, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/186,712

(22) Filed: Feb. 26, 2021

(65) Prior Publication Data

US 2022/0059051 A1 Feb. 24, 2022

(30) Foreign Application Priority Data

Aug. 24, 2020 (KR) ..... 10-2020-0106395

(51) Int. Cl.

| | |
|---|---|
| ***G09G 5/10*** | (2006.01) |
| ***G09G 3/20*** | (2006.01) |
| ***G09G 5/393*** | (2006.01) |
| ***G09G 3/3275*** | (2016.01) |

(52) U.S. Cl.

CPC ..... *G09G 5/10* (2013.01); *G09G 3/2007* (2013.01); *G09G 5/393* (2013.01); *G09G 3/3275* (2013.01); *G09G 2320/029* (2013.01); *G09G 2320/0257* (2013.01); *G09G 2320/045* (2013.01); *G09G 2360/145* (2013.01)

(58) Field of Classification Search

CPC ..... G09G 5/10

See application file for complete search history.

(56) References Cited

U.S. PATENT DOCUMENTS

| | | | |
|---|---|---|---|
| 9,837,015 | B2 | 12/2017 | Kwak et al. |
| 10,262,582 | B2 | 4/2019 | Han |
| 2020/0058251 | A1 | 2/2020 | Lee et al. |

FOREIGN PATENT DOCUMENTS

| | | | |
|---|---|---|---|
| KR | 1020180025444 | A | 3/2018 |
| KR | 1020200021012 | A | 2/2020 |
| KR | 102161535 | B1 | 10/2020 |

*Primary Examiner* — Gustavo Polo

(74) *Attorney, Agent, or Firm* — Cantor Colburn LLP

(57) ABSTRACT

A method for restoring deterioration data of a display device, includes: reading deterioration data from a first storage unit; determining whether the deterioration data is abnormal by comparing a first deterioration value of a first block with adjacent deterioration values of adjacent blocks adjacent to the first block; restoring the deterioration data based on a look-up table in which a luminance retention rate according to a degree of deterioration is set and sensing data provided from a sensing unit, when the deterioration data is determined to be abnormal; and generating second image data by compensating for first image data based on the restored deterioration data. The display device includes blocks each including a pixel, the blocks include the first and adjacent blocks, the deterioration data includes deterioration values each representing a degree of deterioration of each of the blocks, and the deterioration values include the first and adjacent deterioration values.

20 Claims, 10 Drawing Sheets

FIG. 5

| AGE | Luminance Retention Rate |
|---|---|
| 0 | 1 |
| 4 | 0.998401 |
| 8 | 0.996805 |
| 12 | 0.995212 |
| 16 | 0.99362 |
| ⋮ | ⋮ |
| 1020 | 0.664979 |
| 1024 | 0.663916 |

<LUT1>

DISPLAY DEVICE AND METHOD FOR RESTORING DETERIORATION DATA OF THE SAME

The application claims priority to Korean patent application 10-2020-0106395, filed on Aug. 24, 2020, and all the benefits accruing therefrom under 35 U.S.C. § 119, the content of which in its entirety is herein incorporated by reference.

BACKGROUND

Field

The present invention relates to a display device and a method for restoring deterioration data of the same.

Description of Related Art

A display device displays an image using pixels including light emitting elements. When a light emitting element is implemented as a light emitting diode, the light emitting element may be deteriorated by use. The deteriorated light emitting element may emit light with lower luminance than the non-deteriorated light emitting element for the same grayscale value.

In order to prevent an afterimage, the display device may calculate the deterioration amount (or lifetime) of a pixel by calculating the total amount of luminance of light emitted by the pixel, and compensate for a grayscale value based on the calculated deterioration amount. The pixel (or light emitting element) may use an afterimage compensation algorithm to emit light with a desired luminance based on the compensated grayscale value.

The display device may store deterioration data (or data including the deterioration amount calculated for each pixel) in a nonvolatile memory such as a flash memory in order to stably store the deterioration data regardless of power supply. In addition, when the display device is driven, the deterioration data may be read from the nonvolatile memory to compensate for the grayscale value of a first image data.

SUMMARY

However, when an error occurs in the nonvolatile memory, the display device may not normally perform the compensation, and the afterimage may be displayed on the displayed image. For example, when the deterioration data stored in the nonvolatile memory is initialized to 0, the deterioration portion is compensated with the compensation amount smaller than the required compensation amount, so that the deterioration portion may be visually recognized darker than the peripheral portion. Conversely, when an error in which the deterioration data stored in the nonvolatile memory becomes a maximum value (for example, 1024 when the deterioration data is 10 bits) occurs, the deterioration portion is compensated with the compensation amount larger than the required compensation amount, so that the deterioration portion may be visually recognized brighter than the peripheral portion.

A technical problem to be solved by the present invention is to provide a display device capable of determining whether deterioration data stored in a nonvolatile memory is normal, and restoring the deterioration data to compensate for an afterimage when the deterioration data is determined to be abnormal.

However, technical problems to be solved by the present invention are not limited to the above-described technical problems, and may be variously extended without departing from the spirit and scope of the present invention.

A display device according to an embodiment of the present invention includes: a pixel unit including blocks, where each of the blocks includes at least one pixel; a first storage unit which stores deterioration data including deterioration values, where each of the deterioration values represents a degree of deterioration of each of the blocks; a deterioration compensator including a compensator which generates second image data by compensating for first image data based on the deterioration data; a data driver which generates data signals based on the second image data and supplies the data signals to the pixel unit; and a sensing unit which receives a sensing signal corresponding to the data signals from the pixel unit and calculating sensing data based on the sensing signal.

The deterioration compensator further includes a deterioration data controller which determines whether the deterioration data is abnormal by comparing a size of a first deterioration value of a first block with sizes of adjacent deterioration values of adjacent blocks adjacent to the first block; and a deterioration data restoration unit which restores the deterioration data based on a look-up table in which a luminance retention rate according to the degree of deterioration is set and the sensing data, when the deterioration data is determined to be abnormal. The blocks include the first and adjacent blocks, and the deterioration values stored in the first storage unit include the first and adjacent deterioration values.

The deterioration data controller may determine that the deterioration data is abnormal when a value obtained by dividing the first deterioration value by a minimum value among the adjacent deterioration values is greater than a predetermined threshold value except for a case that the minimum value is zero, or a value obtained by dividing a maximum value among the adjacent deterioration values by the first deterioration value is greater than the predetermined threshold value.

The look-up table may store the deterioration values having 4 size intervals from 0 to 1024, and the deterioration data restoration unit may calculate a deterioration value that is not stored in the look-up table through a linear interpolation operation.

The sensing data may include the luminance retention rate of each of the blocks, and the luminance retention rate may be a quantity obtained by comparing a current luminance of each of the blocks with a previous luminance of each of the block before deterioration of the blocks proceeds.

The deterioration data restoration unit may update the deterioration values of all the blocks based on the look-up table and the luminance retention rate included in the sensing data, and calculate restored deterioration data corresponding to the updated deterioration values.

The display device may further include a second storage unit which stores the restored deterioration data, and the first storage unit may be implemented as a nonvolatile memory and the second storage unit may be implemented as a volatile memory.

The deterioration data controller may accumulate grayscale values for the blocks included in the first image data in the restored deterioration data over time to update the restored deterioration data in real time from a restoration time point, and periodically store updated restored deterioration data in the first storage unit.

A display device according to an embodiment of the present invention includes: a pixel unit including blocks, where each of the blocks includes at least one pixel; a first storage unit which stores deterioration data including deterioration values, where each of the deterioration values represents a degree of deterioration of each of the blocks; a deterioration compensator including a compensator which generates second image data by compensating for first image data based on the deterioration data; and a data driver which generates data signals based on the second image data and supplies the data signals to the pixel unit.

The deterioration compensator further includes a deterioration data controller which determines whether the deterioration data is abnormal by comparing a size of a first deterioration value of a first block with sizes of adjacent deterioration values of adjacent blocks adjacent to the first block; and a deterioration data restoration unit which restores the deterioration data based on a look-up table in which a luminance retention rate according to the degree of deterioration is set and captured image data provided from outside when the deterioration data is determined to be abnormal. The blocks include the first and adjacent blocks, and the deterioration values stored in the first storage unit include the first and adjacent deterioration values.

The deterioration data controller may determine that the deterioration data is abnormal when a value obtained by dividing the first deterioration value by a minimum value among the adjacent deterioration values is greater than a predetermined threshold value except for a case that the minimum value is zero, or a value obtained by dividing a maximum value among the adjacent deterioration values by the first deterioration value is greater than the predetermined threshold value.

The look-up table may store the deterioration values having 4 size intervals from 0 to 1024, and the deterioration data restoration unit may calculate a deterioration value that is not stored in the look-up table through a linear interpolation operation.

The captured image data may include a current luminance of each of the blocks of the pixel unit obtained by an imaging device.

The deterioration data restoration unit may compare the current luminance with a previous luminance of each of the blocks before deterioration of the blocks proceeds to obtain the luminance retention rate for the each of the blocks of the pixel unit.

The deterioration data restoration unit may update the deterioration values of all the blocks based on the look-up table and the luminance retention rate obtained by the deterioration data restoration unit, and calculate restored deterioration data corresponding to the updated deterioration values.

The display device may further include a second storage unit which stores the restored deterioration data, and the first storage unit may be implemented as a nonvolatile memory and the second storage unit may be implemented as a volatile memory.

The deterioration data controller may accumulate grayscale values for the blocks included in the first image data in the restored deterioration data over time to update the restored deterioration data in real time from a restoration time point, and periodically store updated restored deterioration data in the first storage unit.

A method for restoring deterioration data of a display device according to an embodiment of the present invention includes reading deterioration data from a first storage unit; determining whether the deterioration data is abnormal by comparing a size of a first deterioration value of a first block with sizes of adjacent deterioration values of adjacent blocks adjacent to the first block; restoring the deterioration data based on a look-up table in which a luminance retention rate according to a degree of deterioration is set and sensing data provided from a sensing unit when the deterioration data is determined to be abnormal; and generating second image data by compensating for first image data based on the restored deterioration data. The display device includes blocks each including at least one pixel, the blocks include the first and adjacent blocks, the deterioration data includes deterioration values each representing a degree of deterioration of each of the blocks, and the deterioration values include the first and adjacent deterioration values.

In the determining whether the deterioration data is abnormal, when a value obtained by dividing the first deterioration value by a minimum value among the adjacent deterioration values is greater than a predetermined threshold value except for a case that the minimum value is zero, or a value obtained by dividing a maximum value among the adjacent deterioration values by the first deterioration value is greater than the predetermined threshold value, the deterioration data may be determined to be abnormal.

The look-up table may store the deterioration values having 4 size intervals from 0 to 1024, and the restoring of the deterioration data may include calculating a deterioration value that is not stored in the look-up table through a linear interpolation operation.

The display device may include a pixel unit including the blocks, the sensing data may include the luminance retention rate of each of the blocks, and the luminance retention rate may be a quantity obtained by comparing a current luminance of each of the blocks with a previous luminance of each of the blocks before deterioration of the blocks proceeds.

The restoring of the deterioration data may include updating the deterioration values of all the blocks based on the look-up table and the luminance retention rate included in the sensing data; and calculating restored deterioration data corresponding to the updated deterioration values.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

FIG. 5 is a diagram illustrating an embodiment of a look-up table created based on the lifetime-luminance function of FIG. 4.

DETAILED DESCRIPTION

Figure 1:
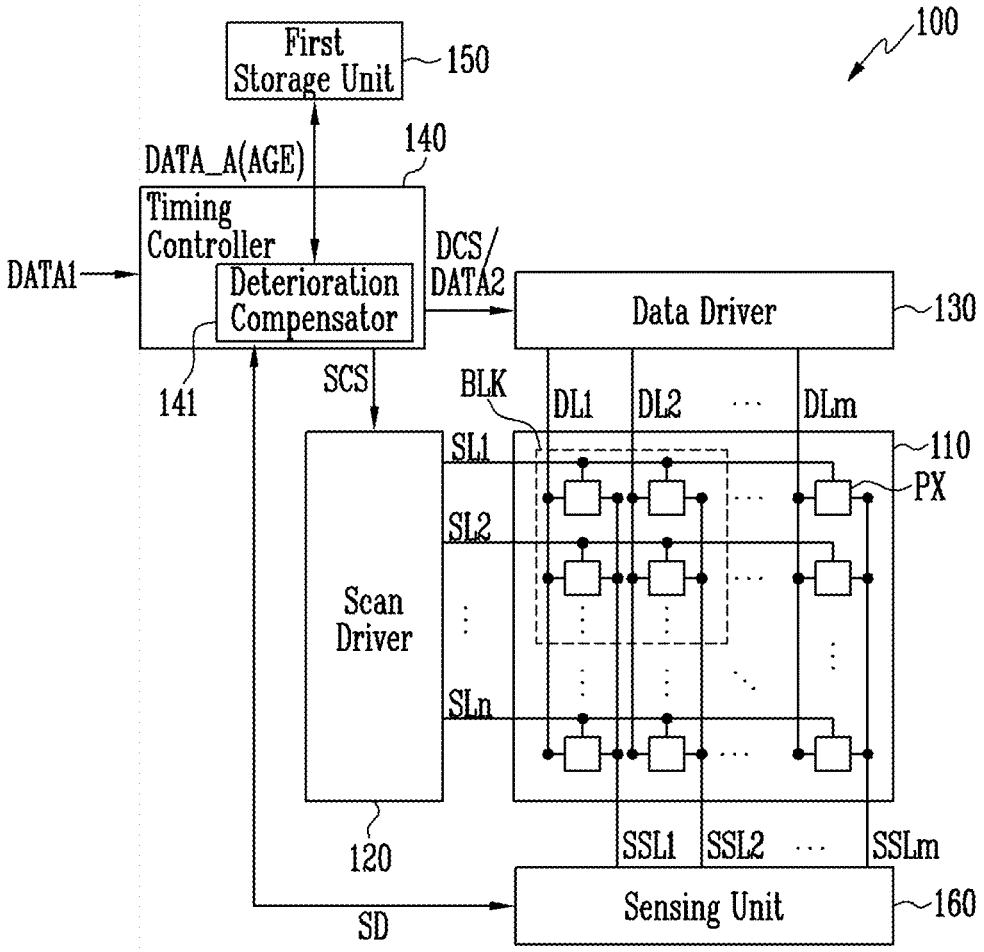
FIG. 1 is a block diagram illustrating a display device according to embodiments of the present invention.

Hereinafter, exemplary embodiments of the present invention will be described in detail with reference to the accompanying drawings. The same reference numerals are used for the same elements in the drawings, and duplicate descriptions for the same elements are omitted. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprise" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

FIG. 1 is a block diagram illustrating a display device according to embodiments of the present invention.

Referring to FIG. 1, a display device 100 may include a pixel unit 110 (in other words, "display panel"), a scan driver 120, a data driver 130, a timing controller 140, a first storage unit 150, and a sensing unit 160. In addition, the timing controller 140 may include a deterioration compensator 141.

The pixel unit 110 may include scan lines SL1 to SLn, data lines DL1 to DLm, sensing lines SSL1 to SSLm, and pixels PX, where n and m may be positive integers. The pixels PX may be provided in areas (for example, pixel areas) partitioned by the scan lines SL1 to SLn, the data lines DL1 to DLm, and the sensing lines SSL1 to SSLm, respectively.

Each pixel PX may include a light emitting element and at least one transistor. At least one transistor may transmit a current (specifically, the amount of current) corresponding to a data signal provided through a data line to the light emitting element in response to a scan signal provided through a scan line. The light emitting element may emit light at a luminance corresponding to the current (that is, a luminance corresponding to the data signal). Here, the light emitting element may include an organic light emitting diode and an inorganic light emitting element.

In an embodiment, the pixel unit 110 may include blocks BLK (in other words, areas), and each of the blocks BLK may include at least one pixel PX. Here, the blocks BLK may be a criterion (e.g., unit) for calculating deterioration data DATA_A (e.g., lifetime data or accumulated data) to be described later. For example, the deterioration data DATA_A may include a plurality of deterioration values AGE. The deterioration values AGE may each represent a degree of deterioration of a corresponding block BLK among the blocks BLK, or an average degree of deterioration or average lifetime of at least one pixel PX included in the corresponding block BLK. For example, each deterioration value AGE may be a value obtained by accumulating a grayscale value for at least one pixel PX included in the corresponding block BLK over time, or a value proportional thereto.

In an embodiment, for example, each of the blocks BLK may include 8×8 pixels. That is, each of the blocks BLK may have a size of 8 [rows]×8 [columns] based on the pixel PX as a unit. That is, the pixel unit 110 may be divided into the blocks BLK each having the size of 8×8. For example, when the pixel unit 110 includes n×m pixels, the pixel unit 110 may be divided into n×m/64 blocks BLK (that is, j×i blocks BLK in FIG. 3).

The scan driver 120 may generate scan signals based on a scan control signal SCS and may sequentially provide the scan signals to the scan lines SL1 to SLn. Here, the scan control signal SCS may include a start signal, clock signals, or the like, and may be provided from the timing controller 140. For example, the scan driver 120 may include a shift register that sequentially generates and outputs the scan signals of a pulse shape corresponding to the start signal of a pulse shape using the clock signals.

The data driver 130 may generate data signals based on second image data DATA2 (e.g., compensated image data) and a data control signal DCS provided from the timing controller 140, and provide the data signals to the pixel unit 110 (e.g., pixels PX). Here, the data control signal DCS may be a signal that controls an operation of the data driver 130 and may include a load signal (e.g., data enable signal) or the like indicating an output of a valid data signal.

The first storage unit 150 may be connected to the timing controller 140, and the first storage unit 150 may store the deterioration data DATA_A. For example, the first storage unit 150 may be implemented as a nonvolatile memory device such as an erasable programmable read-only memory ("EPROM"), an electrically erasable programmable read-only memory ("EEPROM"), a flash memory, a phase change random access memory ("PRAM"), a resistance random access memory ("RRAM"), a nano floating gate memory ("NFGM"), a polymer random access memory ("PoRAM"), a magnetic random access memory ("MRAM"), a ferroelectric random access memory ("FRAM"), or the like. The nonvolatile memory may store data in a state in which power is not supplied. In addition, the nonvolatile memory is relatively inexpensive and has a feature that can store a large capacity.

When the display device 100 is powered on, the timing controller 140 (specifically, deterioration compensator 141) may request the first storage unit 150 to provide the deterioration values AGE included in the deterioration data DATA_A. The deterioration data DATA_A in the first storage unit 150 may be updated periodically and/or before the display device 100 is powered off.

The timing controller 140 may receive first image data DATA1 (e.g., input image data) and a control signal from an external device (for example, a graphic processor), generate the scan control signal SCS and the data control signal DCS based on the control signal, and convert the first image data DATA1 to generate the second image data DATA2.

The sensing unit 160 may generate sensing data SD including characteristic values of the pixels PX based on sensing values provided from the sensing lines SSL1 to SSLm. For example, the sensing unit 160 may detect a change in a threshold voltage and a change in mobility of a driving transistor included in the pixel PX, a change in characteristics of the light emitting element, or the like, and calculate a luminance retention rate of each of the blocks BLK from the detected information above. In this case, the luminance retention rate may be a value obtained by comparing current luminance of the block BLK with the previous luminance before deterioration of the block BLK proceeds. According to an embodiment, the first storage unit 150 may store luminance information before deterioration of each of the blocks BLK proceeds. The sensing unit 160 may receive the luminance information from the first storage unit 150 when calculating the luminance retention rate.

According to an embodiment of the present invention, the timing controller 140 may include the deterioration compensator 141.

The deterioration compensator 141 may load the deterioration values AGE included in the deterioration data DATA_A from the first storage unit 150, update the deterioration values AGE based on grayscale values included in the first image data DATA1, and generate the second image data DATA2 (e.g., compensated image data) by compensating for the first image data DATA1 based on the updated deterioration values AGE. The deterioration data DATA_A stored in the first storage unit 150 may be updated in real time or periodically based on the updated deterioration values AGE.

In addition, the deterioration compensator 141 may determine whether the deterioration data DATA_A provided from the first storage unit 150 is normal. For example, the deterioration compensator 141 may determine whether the deterioration data DATA_A is normal by comparing a size of any one specific deterioration value AGE included in the deterioration data DATA_A with sizes of adjacent deterioration values AGE of adjacent blocks BLK adjacent to the block having specific deterioration value AGE.

In addition, when the deterioration data DATA_A is determined to be abnormal, the deterioration compensator 141 may restore the deterioration data DATA_A based on a look-up table in which the luminance retention rate according to the degree of deterioration is set and the sensing data SD received from the sensing unit 160.

A detailed configuration of the deterioration compensator 141 will be described in detail with reference to FIGS. 2 to 8.

In an embodiment, at least one of the scan driver 120, the data driver 130, the timing controller 140, and the sensing unit 160 may be disposed on the pixel unit 110 or implemented as an IC and mounted on a flexible circuit board connected to the pixel unit 110.

Figure 2:
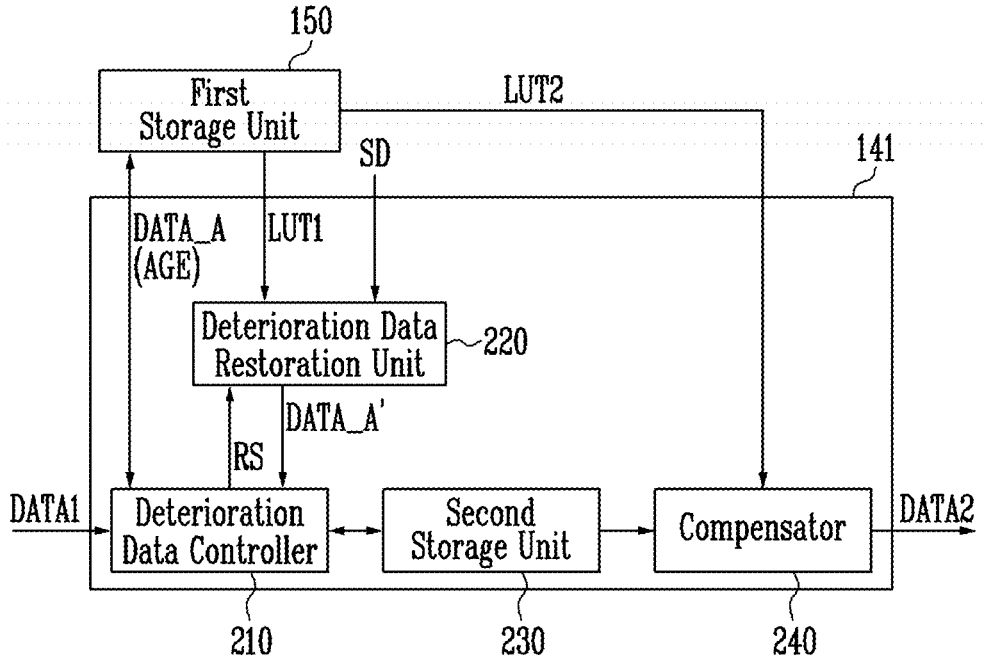
FIG. 2 is a diagram illustrating an example of a deterioration compensator included in the display device of FIG. 1.
Figure 3:
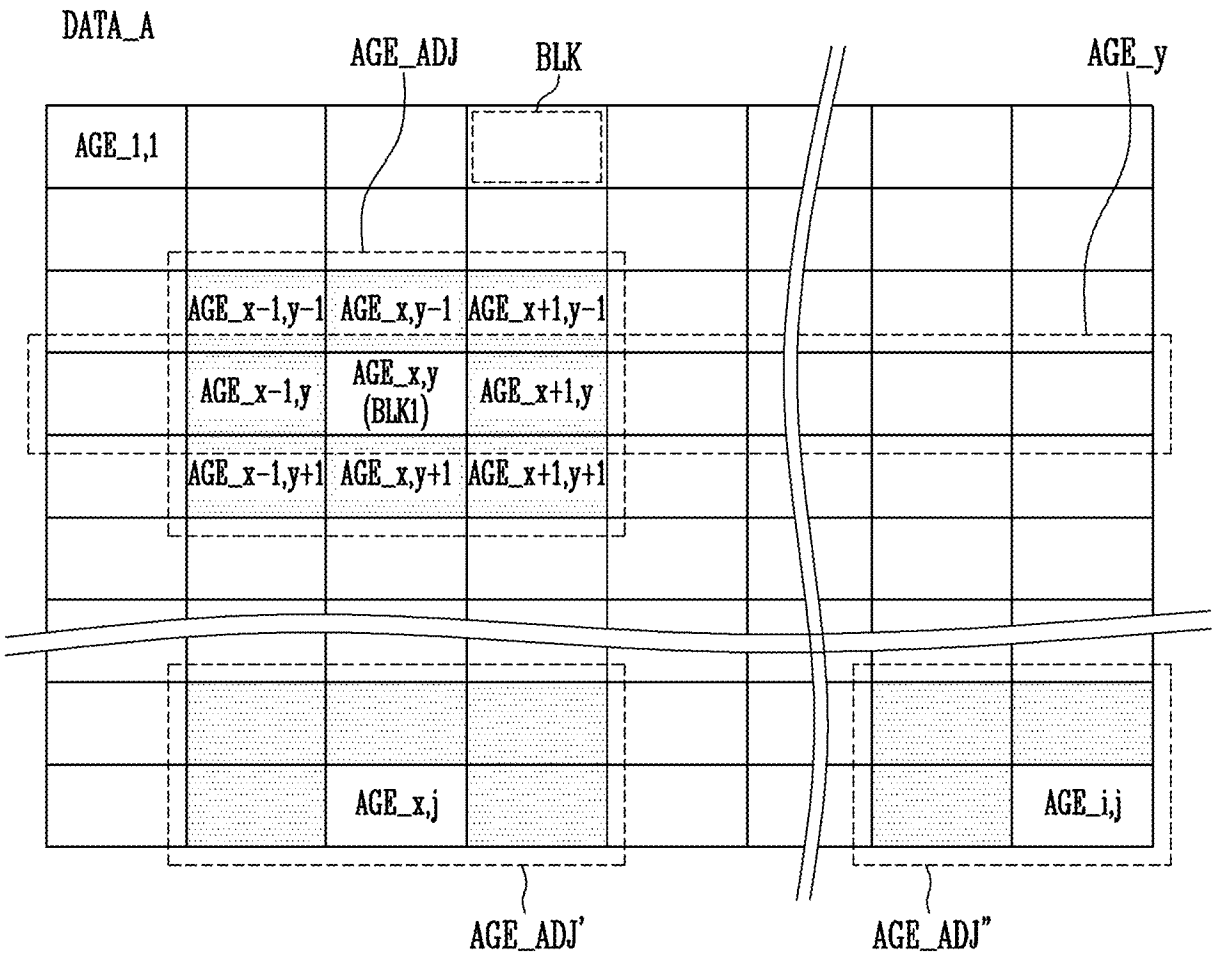
FIG. 3 is a diagram illustrating an example of deterioration data used in the deterioration compensator of FIG. 2.
Figure 4:
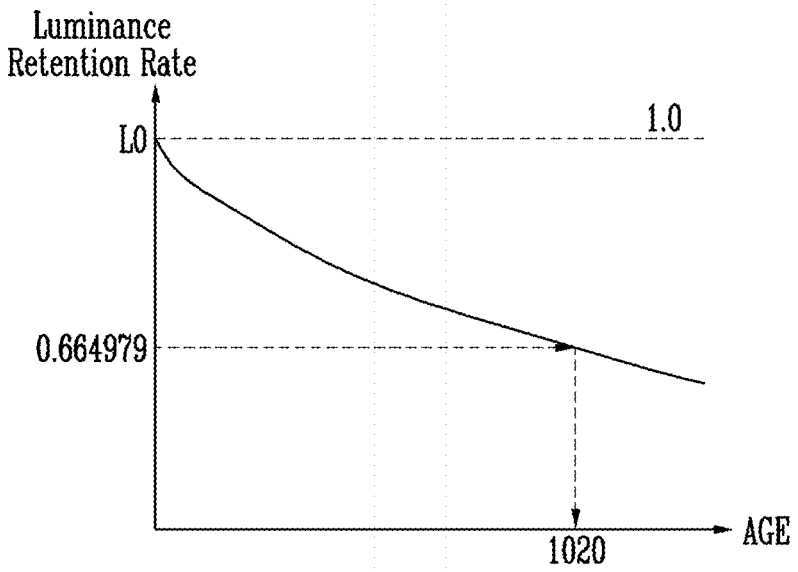
FIG. 4 is an exemplary graph corresponding to a lifetime-luminance function of a block (or pixel).
Figure 6:
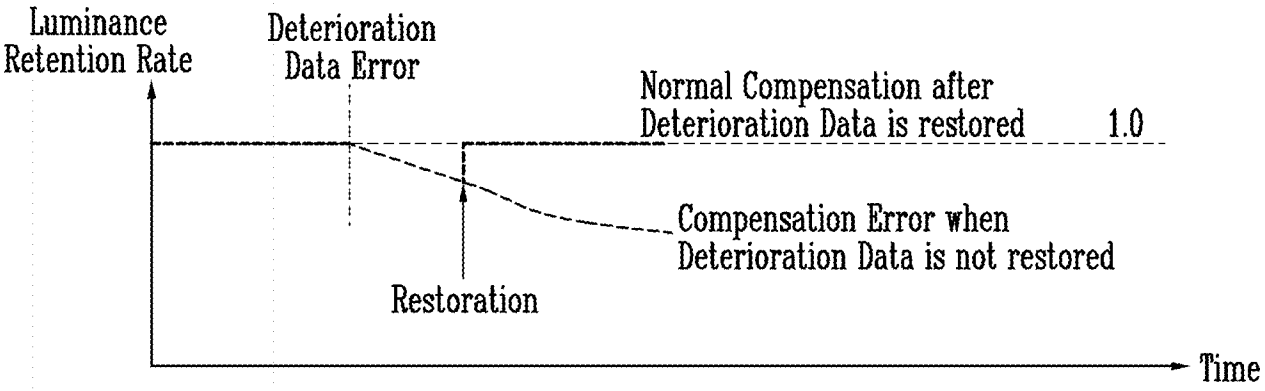
FIGS. 6 and 7 are diagrams for explaining a restoration time point of the deterioration data.
Figure 7:
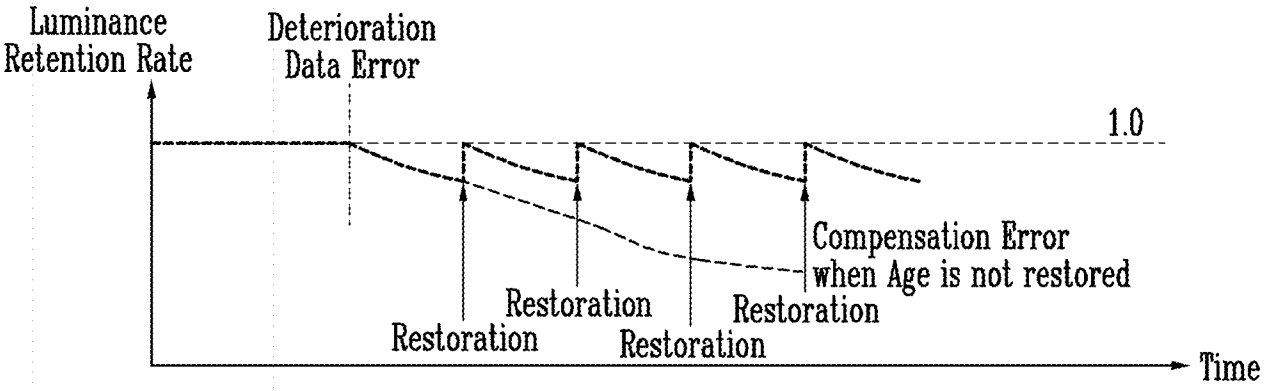
Figure 8:
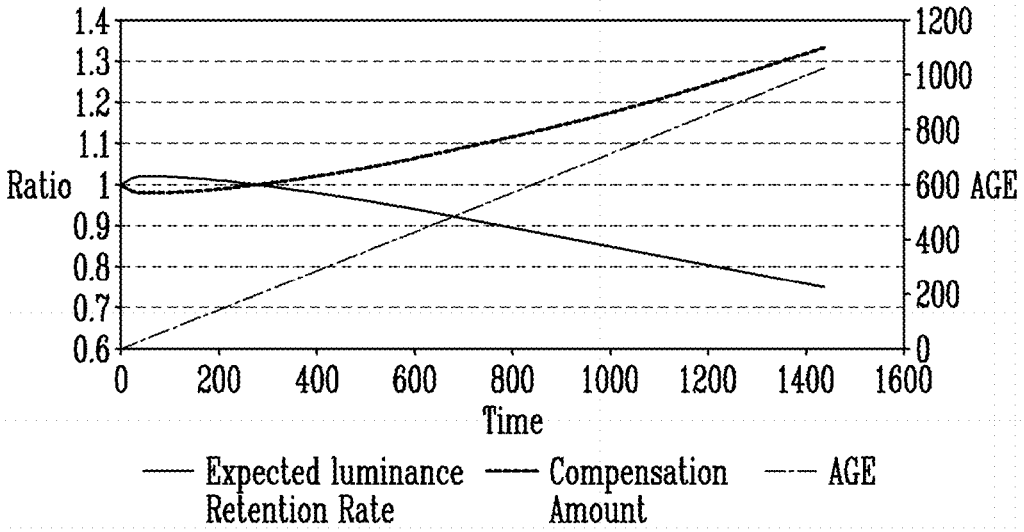
FIG. 8 is a diagram for explaining an expected luminance retention rate according to a degree of deterioration and the compensation amount corresponding to the luminance retention rate.

FIG. 2 is a diagram illustrating an example of a deterioration compensator included in the display device of FIG. 1. FIG. 3 is a diagram illustrating an example of deterioration data used in the deterioration compensator of FIG. 2. FIG. 4 is an exemplary graph corresponding to a lifetime-luminance function of a block (or pixel). FIG. 5 is a diagram illustrating an embodiment of a look-up table created based on the lifetime-luminance function of FIG. 4. FIGS. 6 and 7 are diagrams for explaining a restoration time point of the deterioration data. FIG. 8 is a diagram for explaining an expected luminance retention rate according to a degree of deterioration and the compensation amount corresponding to the luminance retention rate.

Referring to FIGS. 2 to 8, the deterioration compensator 141 may include a deterioration data controller 210, a deterioration data restoration unit 220, a second storage unit 230, and a compensator 240.

When the display device 100 is initially driven, the deterioration data controller 210 may read the deterioration data DATA_A from the first storage unit 150 and determine whether the read deterioration data DATA_A is normal.

Referring to FIG. 3, the deterioration data controller 210 may determine whether the deterioration data DATA_A provided from the first storage unit 150 is abnormal by comparing a size of a first deterioration value AGE_x,y (i.e., a specific deterioration value of a first block BLK at x-th column and y-th row among i×j blocks BLK) among a plurality of deterioration values AGE_1,1 to AGE_i,j included in the deterioration data DATA_A with sizes of adjacent deterioration values AGE_ADJ of adjacent blocks BLK adjacent to the block having the first deterioration value AGE_x,y.

The deterioration data DATA_A may include the plurality of deterioration values AGE_1,1 to AGE_i,j corresponding to the blocks BLK, respectively. When the blocks BLK are composed of an i×j matrix, since the deterioration values AGE are calculated by a unit of the block BLK, the deterioration data DATA_A may include i×j deterioration values AGE_1,1 to AGE_i,j. That is the total number of deterioration values AGE is i×j, i is a positive integer and the total number of the columns of the blocks BLK, and j is a positive integer and the total number of the rows of the blocks BLK.

The first deterioration value AGE_x,y (in other words, an x,y-th deterioration value) included in an y-th row deterioration value AGE_y may have eight adjacent blocks BLK which having eight adjacent deterioration values AGE_x−1,y−1, AGE_x,y−1, AGE_x+1,y−1, AGE_x−1,y, AGE_x+1,y, AGE_x−1,y+1, AGE_x,y+1, and AGE_x+1,y+1 (e.g., AGE_ADJ).

According to an embodiment of the present invention, when a value obtained by dividing the first deterioration value AGE_x,y by a minimum deterioration value among the adjacent deterioration values AGE_ADJ is greater than a predetermined threshold value except for a case that the minimum deterioration value is zero, or a value obtained by dividing a maximum deterioration value among the adjacent deterioration values AGE_ADJ by the first deterioration value AGE_x,y is greater than the predetermined threshold value, the deterioration data controller 210 may determine that the deterioration data DATA_A is abnormal.

According to an embodiment, the predetermined threshold value may be 20 (or 20 percentages (%)). Considering that it is common for adjacent blocks BLK to have substantially similar deterioration values, when a difference between the size of the deterioration value AGE_x,y for a specific block BLK and any one of the sizes of the adjacent deterioration values AGE_ADJ for the blocks BLK adjacent to the specific blocks BLK is 20 times or more, the deterioration data DATA_A may be determined to be abnormal. However, the threshold value according to the invention is not limited to 20, and may be variously modified according to accuracy of the compensation.

In an embodiment, when the display device 100 is deteriorated and the adjacent deterioration values AGE_ADJ generally have a value of 10 (that is, when average value of the adjacent deterioration values AGE_ADJ is 10), for example, in the case where an (x−1,y−1)th deterioration value AGE_x−1,y−1 is 10, an (x,y−1)th deterioration value AGE_x,y−1 is 9, an (x+1,y−1)th deterioration value AGE_x+1,y−1 is 10, an (x−1,y)th deterioration value AGE_x−1,y is 12, an (x+1,y)th deterioration value AGE_x+1,y is 10, an (x−1,y+1)th deterioration value AGE_x−1,y+1 is 8, an (x,y+1)th deterioration value AGE_x,y+1 is 10, and an (x+1,y+1)th deterioration value AGE AGE_x+1,y+1 is 10, and when the first deterioration value AGE_x,y is 0 or the first deterioration value AGE_x,y is 1024, whether the deterioration data DATA_A is normal may be determined through the following process.

For reference, the case where the first deterioration value AGE_x,y is 0 may be a case where the first deterioration value AGE is initialized since the deterioration data DATA_A stored in the first storage unit 150 is damaged. The case where the first deterioration value AGE_x,y is 1024 may be a case where the first deterioration value AGE is changed to a maximum deterioration value since noise is generated in the deterioration data DATA_A stored in the first storage unit 150, assuming that the deterioration value is represented by 10 bits.

First, in the above case, for example, the deterioration data controller 210 may determine 8, which is the (x−1,y+1)th deterioration value AGE_x−1,y+1, as a minimum value of the adjacent deterioration values AGE_ADJ, determine 12, which is the (x−1,y)th deterioration value AGE_x−1,y, as a maximum value of the adjacent deterioration values AGE_ADJ. When the first deterioration value AGE_x,y is 0, the deterioration data controller 210 may calculate a value obtained by dividing the first deterioration value AGE_x,y by the minimum deterioration value among the adjacent deterioration values AGE_ADJ to get 0, and calculate a value obtained by dividing the maximum deterioration value among the adjacent deterioration values AGE_ADJ by the first deterioration value AGE_x,y as infinity. Since the value obtained by dividing the maximum deterioration value among the adjacent deterioration values AGE_ADJ by the first deterioration value AGE_x,y is greater than 20, which is the threshold value, the deterioration data controller 210 may determine that the deterioration data DATA_A is abnormal.

Next, for example, when the first deterioration value AGE_x,y is 1024, the deterioration data controller 210 may determine 8, which is the (x−1,y+1)th deterioration value AGE_x−1,y+1, as the minimum value of the adjacent deterioration values AGE_ADJ, determine 12, which is the (x−1,y)th deterioration value AGE_x−1,y, as the maximum value of the adjacent deterioration values AGE_ADJ, calculate a value obtained by dividing the first deterioration value AGE_x,y by the minimum deterioration value among the adjacent deterioration values AGE_ADJ as 1024/8=128, and calculate a value obtained by dividing the maximum deterioration value among the adjacent deterioration values AGE_ADJ by the first deterioration value AGE_x,y as 12/1024=0.012. Since the value 128 obtained by dividing the first deterioration value AGE_x,y by the minimum deterioration value among the adjacent deterioration values AGE_ADJ is greater than 20, which is the threshold value, the deterioration data controller 210 may determine that the deterioration data DATA_A is abnormal.

In this case, the deterioration data controller 210 may perform the above operation on all deterioration values AGE included in the deterioration data DATA_A. In addition, when the deterioration values AGE_x,y is compared with the adjacent deterioration values AGE_ADJ and any result greater than the threshold value is derived, the deterioration data controller 210 may determine that the deterioration data DATA_A is abnormal.

The number of adjacent blocks BLK adjacent to the first block BLK having the first deterioration value AGE_x,y may vary according to a position of the first block BLK in the pixel unit 110. For example, the number of adjacent deterioration values AGE_ADJ corresponding to an x,y-th deterioration value AGE_x,y of the block BLK positioned at a center of the pixel unit 110 may be eight. The number of adjacent deterioration values AGE_ADJ' corresponding to an x,j-th deterioration value AGE_x,j of the block BLK positioned at one side of the pixel unit 110 may be five. The number of adjacent deterioration values AGE_ADJ" corresponding to an i,j-th deterioration value AGE_i,j of the block BLK positioned at one edge of the pixel unit 110 may be three, where i and j may be positive integers.

When the deterioration data DATA_A provided from the first storage unit 150 is determined to be abnormal, the deterioration data controller 210 may provide a restoration signal RS to the deterioration data restoration unit 220.

Referring to FIG. 2 again, when the deterioration data restoration unit 220 receives the restoration signal RS from the deterioration data controller 210, the deterioration data restoration unit 220 may restore the deterioration data DATA_A based on a first look-up table LUT1 in which the luminance retention rate according to the degree of deterioration is set and the sensing data SD provided from the sensing unit 160.

Referring to the lifetime-luminance function shown in FIG. 4, the block BLK (or pixel PX) may initially emit light with a first luminance LO (that is, AGE=0). However, as the deterioration proceeds, the luminance of light emitted from the block BLK may gradually decrease. In this case, the horizontal axis represents the degree of deterioration, and the vertical axis represents the luminance retention rate of the block BLK corresponding to a corresponding deterioration time point. The luminance retention rate may be a size obtained by comparing the current luminance of the blocks BLK (i.e., luminance after deterioration of the blocks proceeds) with the first luminance LO of the blocks BLK (i.e., luminance before deterioration of the blocks proceeds).

The first look-up table LUT1 shown in FIG. 5 may include luminance retention rate information according to the deterioration value AGE of the block BLK based on the lifetime-luminance function of FIG. 4. The first look-up table LUT1 may express the deterioration value AGE having 4 size intervals from 0 to 1024. That is, the deterioration value AGE may include 0, 4, 8, 12, 16, . . . , 1020, and 1024. However, the deterioration data restoration unit 220 may calculate a new deterioration value AGE that is not stored in the first look-up table LUT1 through a linear interpolation operation.

The deterioration data restoration unit 220 may inversely infer the degree of deterioration (i.e., deterioration value AGE) corresponding to the luminance retention rate of the block BLK using the first look-up table LUT1. According to an embodiment, the deterioration data restoration unit 220 may receive the sensing data SD from the sensing unit 160. The sensing data SD may include a current luminance retention rate of each of the blocks BLK. The deterioration data restoration unit 220 may calculate/update the deterioration value AGE of each of the blocks BLK from the current luminance retention rate of each of the blocks BLK using the first look-up table LUT1 independently from the deterioration value AGE stored in the first storage unit 150. For example, as shown in FIG. 4, when the luminance retention rate of a specific block BLK included in the sensing data SD is 0.664979, the deterioration data restoration unit 220 may calculate the deterioration value AGE of the specific block BLK as 1020. The deterioration data restoration unit 220 may restore the deterioration data DATA_A by calculating the deterioration values AGE for all blocks BLK.

In other words, the deterioration data restoration unit 220 may calculate restored deterioration data DATA_A' based on the first look-up table LUT1 and the sensing data SD provided from the sensing unit 160.

The deterioration data restoration unit 220 may provide the restored deterioration data DATA_A' to the deterioration data controller 210. The deterioration data restoration unit 220 may be implemented as a circuit or a microprocessor.

When the read deterioration data DATA_A is determined to be normal, the deterioration data controller 210 may load the deterioration data DATA_A into the second storage unit 230. Also, when the deterioration data DATA_A is restored by the deterioration data restoration unit 220, the deterioration data controller 210 may load the restored deterioration data DATA_A' into the second storage unit 230. For convenience of description, hereinafter, the description will be made on the premise that the deterioration data DATA_A includes the restored deterioration data DATA_A'.

The second storage unit 230 may be implemented as a volatile memory device such as a dynamic random access memory ("DRAM"), a static random access memory ("SRAM"), a mobile DRAM, or the like. The volatile memory cannot store data in a state in which power is not supplied, but has a feature that can process the data at a relatively high speed.

Since the first storage unit 150 has a slower speed than the second storage unit 230, when the display device 100 is driven, it may be difficult for the display device 100 to directly access the first image data DATA1 to compensate for the deterioration. Accordingly, the deterioration data controller 210 may read the deterioration data DATA_A from the first storage unit 150, load the deterioration data DATA_A into the second storage unit 230, and process the first image data DATA1 using the deterioration data DATA_A stored in the second storage unit 230.

In addition, the deterioration data controller 210 may update the deterioration data DATA_A stored in the second storage unit 230. When the display device 100 is driven, the deterioration data DATA_A may need to be updated in real time. Accordingly, the deterioration data controller 210 may update the deterioration data DATA_A stored in the second storage unit 230 using the first image data DATA1. For example, the deterioration data controller 210 may update the deterioration data DATA_A stored in the second storage unit 230 by accumulating grayscale values of the blocks BLK included in the first image data DATA1 in the deterioration data DATA_A over time.

The deterioration data controller 210 may store the deterioration data DATA_A stored in the second storage unit 230 in the first storage unit 150. The second storage unit 230 cannot store data stored in a state in which power is not supplied. Accordingly, the deterioration data controller 210 may store the deterioration data DATA_A stored in the second storage unit 230 in the first storage unit 150 in order not to lose the updated deterioration data DATA_A. In an embodiment, the deterioration data controller 210 may periodically store the deterioration data DATA_A stored in the second storage unit 230 in the first storage unit 150. In another embodiment, the deterioration data controller 210 may store the deterioration data DATA_A stored in the second storage unit 230 in the first storage unit 150 when driving of the display device 100 is finished.

As described above, according to an embodiment of the present invention, as shown in FIG. 6, like the deterioration data DATA_A that has not been damaged, the deterioration data controller 210 may update the restored deterioration data DATA_A' in real time from a restoration time point, and periodically store the restored deterioration data DATA_A' in the first storage unit 150. That is, as long as an error does not occur in the first storage unit 150, the deterioration data controller 210 does not need to request the deterioration data restoration unit 220 for additional restoration of the restored deterioration data DATA_A'.

According to another embodiment, as shown in FIG. 7, the deterioration data controller 210 may request the deterioration data restoration unit 220 to periodically restore the deterioration data DATA_A instead of updating the restored deterioration data DATA_A' in real time. For example, the deterioration data controller 210 may request the deterioration data restoration unit 220 to restore the deterioration data DATA_A whenever the display device 100 is powered on.

Although not shown in the drawings, the deterioration data controller 210 may separately configure a deterioration value accumulator. The deterioration value accumulator may perform a function of updating the deterioration data DATA_A or the restored deterioration data DATA_A' stored in the second storage unit 230 described above.

The embodiment shown in FIG. 6 may be advantageous when the deterioration value accumulator operates normally. The embodiment shown in FIG. 7 may be advantageous when the deterioration value accumulator does not operate normally.

The second storage unit 230 may store the deterioration data DATA_A while the display device 100 is being driven. The second storage unit 230 cannot store data in a state in which power is not supplied, but has a feature that can process the data at a relatively high speed. Accordingly, while the display device 100 is being driven, the deterioration data DATA_A may be stored in the second storage unit 230, and compensation for deterioration of the first image data DATA1 may be performed.

The compensator 240 may generate the second image data DATA2 by compensating for a grayscale of the first image data DATA1 using the deterioration data DATA_A stored in the second storage unit 230. In an embodiment, the compensator 240 may read the deterioration values AGE of the blocks BLK from the deterioration data DATA_A stored in the second storage unit 230, and generate the second image data DATA2 using a predetermined second look-up table LUT2.

The second look-up table LUT2 may include the grayscale compensation amount according to the deterioration value AGE. The second look-up table LUT2 may include the grayscale compensation amount calculated so that the blocks BLK may be displayed with the luminance before deterioration based on the luminance retention rate corresponding to the deterioration value AGE. For example, as shown in FIG. 8, the grayscale compensation amount may have a relationship that increases as the luminance retention rate decreases.

As described above, the deterioration data controller 210 may determine whether the deterioration data DATA_A stored in the first storage unit 150 is normal, and when the deterioration data DATA_A is determined to be abnormal, the deterioration data controller 210 may control the deterioration data restoration unit 220 to restore the deterioration data DATA_A. Therefore, even if the deterioration data DATA_A stored in the first storage unit 150 is damaged, the deterioration data controller 210 may detect and restore this to normally compensate for the grayscale of the first image data DATA1. Accordingly, an afterimage may be prevented from occurring in the second image data DATA2.

Hereinafter, other embodiments will be described. In the following embodiments, descriptions of the same components as those of the previously described embodiments will be omitted or simplified, and differences will be mainly described.

Figure 9:
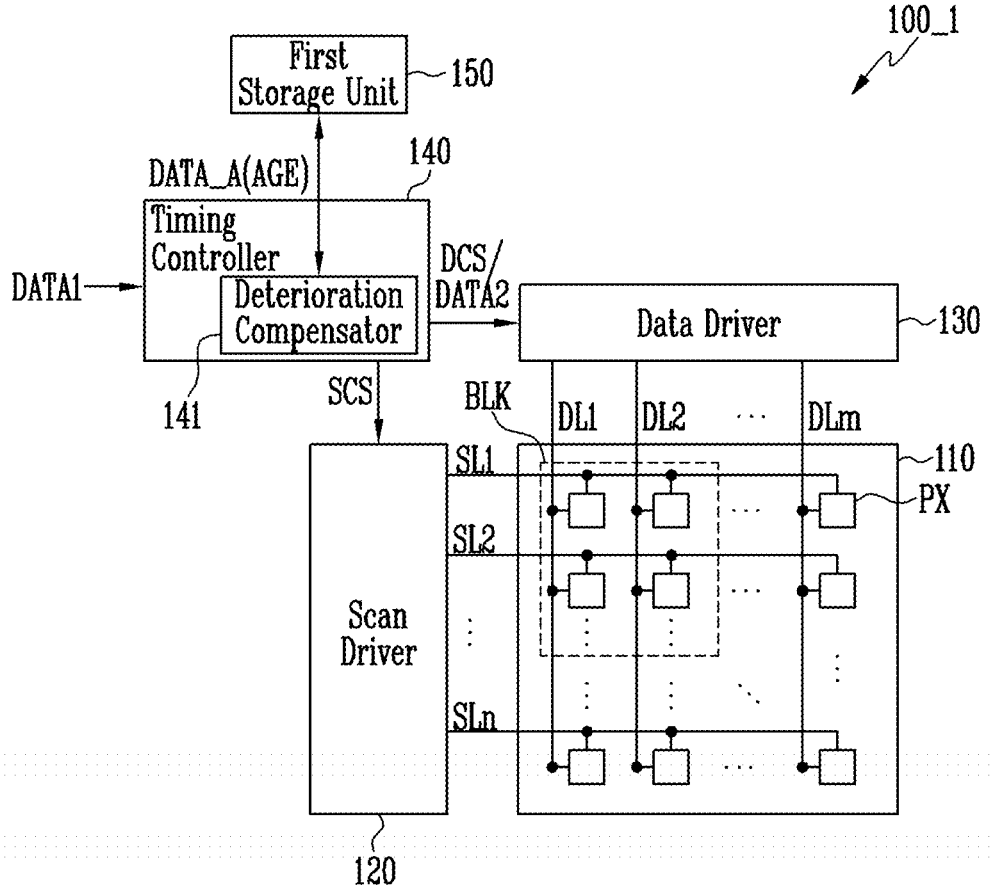
FIG. 9 is a block diagram illustrating a display device according to another embodiment of the present invention.
Figure 10:
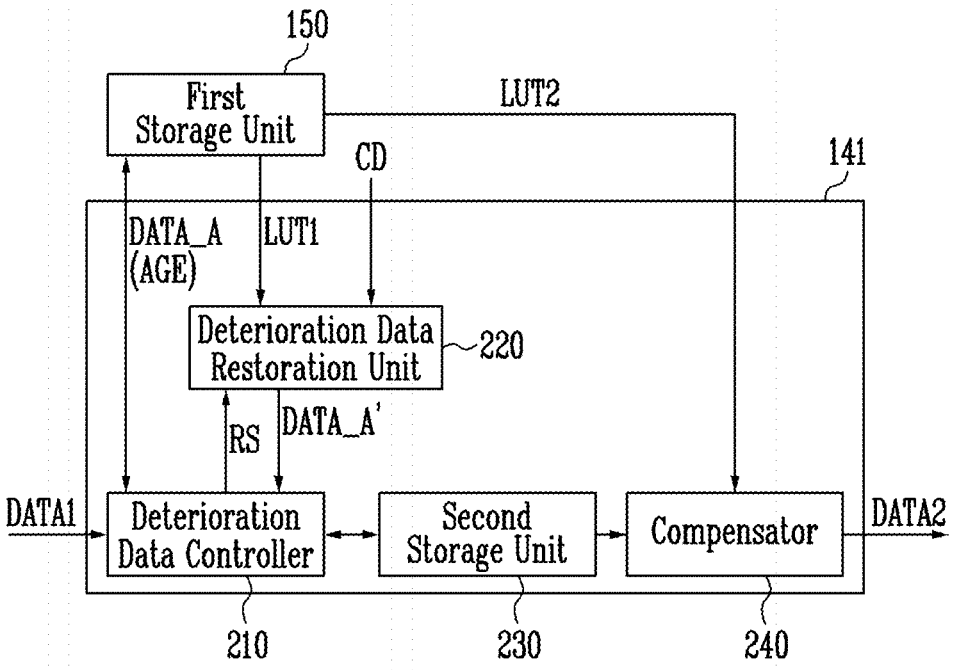
FIG. 10 is a diagram illustrating an example of a deterioration compensator included in the display device of FIG. 9.

FIG. 9 is a block diagram illustrating a display device according to another embodiment of the present invention. FIG. 10 is a diagram illustrating an example of a deterioration compensator included in the display device of FIG. 9.

Referring to FIGS. 9 and 10, as a difference from the embodiment shown in FIGS. 1 and 2, a display device 100_1 may not include the sensing unit 160 (refer to FIG. 1), and the deterioration data restoration unit 220 may restore the deterioration data DATA_A based on the first look-up table LUT1 and captured image data CD provided from the outside.

Specifically, the deterioration data controller 210 may read the deterioration data DATA_A from the first storage unit 150 when the display device 100 is initially driven, and determine whether the read deterioration data DATA_A is normal.

According to an embodiment of the present invention, the deterioration data controller 210 may determine whether the deterioration data DATA_A provided from the first storage unit 150 is normal by comparing the size of a first deterioration value (that is, the specific deterioration value) of a certain one block BLK among the plurality of deterioration values AGE included in the deterioration data DATA_A with the sizes of the adjacent deterioration values AGE_ADJ of the adjacent block adjacent to the certain one block BLK. Since the detailed method for the above determination is the same as described above with reference to FIG. 3, duplicate descriptions will be omitted.

When the deterioration data DATA_A provided from the first storage unit 150 is determined to be abnormal, the deterioration data controller 210 may provide the restoration signal RS to the deterioration data restoration unit 220.

When the deterioration data restoration unit 220 receives the restoration signal RS from the deterioration data controller 210, the deterioration data restoration unit 220 may restore the deterioration data DATA_A based on the first look-up table LUT1 (refer to FIG. 5) in which the luminance retention rate according to the degree of deterioration is set and the captured image data CD provided from the outside (e.g., from a camera that captures current luminance of the pixel unit 110).

The captured imaging data CD may include current luminance information for each position (i.e., for each block BLK) of the pixel unit 110. For example, after displaying the pixel unit 110 in full white, current luminance for each position (i.e., for each block BLK) of the pixel unit 110 may be obtained through an imaging device such as a camera.

The deterioration data restoration unit 220 may obtain luminance retention rate data for each block BLK of the pixel unit 110 by comparing the previous luminance before deterioration of the blocks BLK proceeds with the current luminance of the measured blocks BLK. According to an embodiment, the previous luminance information before deterioration of each of the blocks BLK proceeds may be provided from the first storage unit 150. In this case, the luminance retention rate may be a size obtained by comparing the current luminance of the blocks BLK with the previous luminance before deterioration of the blocks BLK proceeds.

The deterioration data restoration unit 220 may inversely infer the degree of deterioration (i.e., deterioration value AGE) corresponding to the luminance retention rate of the block BLK using the first look-up table LUT1 (refer to FIG. 5). The deterioration data restoration unit 220 may restore the deterioration data DATA_A by calculating the deterioration values AGE for all blocks BLK.

In other words, the deterioration data restoration unit 220 may calculate the restored deterioration data DATA_A' based on the first look-up table LUT1 and the captured imaged data CD provided from the outside.

Since the descriptions of the second storage unit 230 and the compensator 240 are the same as those described above with reference to FIGS. 1 and 2, duplicate descriptions will be omitted.

As described above, the embodiment of restoring the deterioration data DATA_A using the first look-up table LUT1 and the captured image data CD provided from the outside may be advantageous in a structure in which a separate sensing unit 160 (refer to FIG. 1) is not provided in the display device 100_1.

Figure 11:
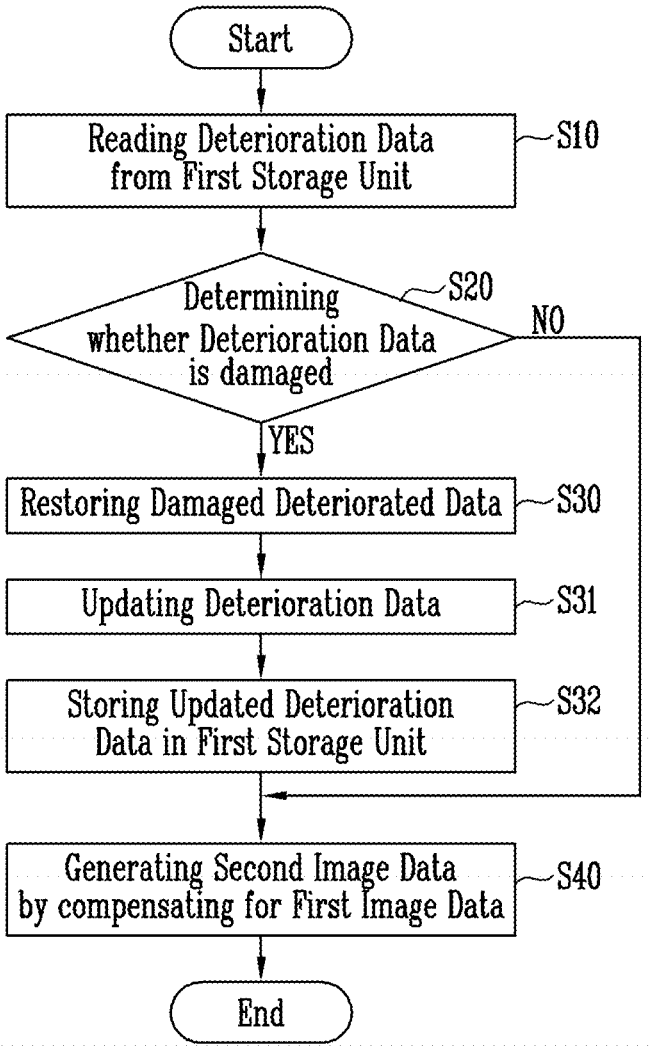
FIG. 11 is a flowchart illustrating a method for restoring deterioration data of a display device according to an embodiment of the present invention.

FIG. 11 is a flowchart illustrating a method for restoring deterioration data of a display device according to an embodiment of the present invention.

Referring to FIGS. 1 to 8 and 11, a method of restoring deterioration data of the display device 100 may include reading deterioration data DATA_A from the first storage unit 150 (S10), determining whether the deterioration data DATA_A is damaged (S20), restoring the damaged deterioration data DATA_A (S30), and generating second image data DATA2 by compensating for grayscale of first image data DATA1 based on the deterioration data DATA_A (S40).

In the method of restoring the deterioration data of the display device 100, the deterioration data DATA_A may be read from the first storage unit 150 (S10).

When the display device 100 is initially driven, the deterioration data controller 210 may read the deterioration data DATA_A from the first storage unit 150. The first storage unit 150 may be implemented as a nonvolatile memory device such as an erasable programmable read-only memory (EPROM), an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), or the like.

Thereafter, the deterioration data controller 210 may determine whether the deterioration data DATA_A is damaged (S20).

The deterioration data controller 210 may determine whether the deterioration data DATA_A provided from the first storage unit 150 is normal by comparing a size of a first deterioration value AGE_x,y of a first block BLK among a plurality of deterioration values AGE included in the deterioration data DATA_A and sizes of adjacent blocks having adjacent deterioration values AGE_ADJ adjacent to the first block BLK.

When a value obtained by dividing the first deterioration value AGE_x,y by a minimum deterioration value among the adjacent deterioration values AGE_ADJ is greater than a predetermined threshold value except for a case that the minimum deterioration value is zero, or a value obtained by dividing a maximum deterioration value among the adjacent deterioration values AGE_ADJ by the first deterioration value AGE_x,y is greater than the predetermined threshold value, the deterioration data controller 210 may determine that the deterioration data DATA_A is abnormal. According to an embodiment, the predetermined threshold may be 20 (or 20%).

Thereafter, when the deterioration data DATA_A is determined to be damaged, the deterioration data DATA_A may be restored (S30).

When the deterioration data restoration unit 220 receives a restoration signal RS from the deterioration data controller 210, the deterioration data restoration unit 220 may restore the deterioration data DATA_A based on a first look-up table LUT1 in which a luminance retention rate according to a degree of deterioration is set, and sensing data SD provided from the sensing unit 160 or captured imaging data CD provided from the outside.

The deterioration data restoration unit 220 may inversely infer the degree of deterioration (i.e., a deterioration value AGE) corresponding to the luminance retention rate of the block BLK using the first look-up table LUT1.

The deterioration data restoration unit 220 may receive the sensing data SD from the sensing unit 160. The sensing data SD may include a current luminance retention rate of each of the blocks BLK. The sensing unit 160 may detect a change in a threshold voltage and a change in mobility of the driving transistor included in the pixel PX, a change in characteristics of the light emitting element, or the like, and calculate the luminance retention rate of each of the blocks BLK from these.

In addition, the deterioration data restoration unit 220 may receive the captured imaging data CD from the outside. The captured imaging data CD may include a current luminance for each position (i.e., for each block BLK) of the pixel unit 110. For example, after displaying the pixel unit 110 in full white, the current luminance for each position (i.e., for each block BLK) of the pixel unit 110 may be obtained through an imaging device such as a camera. The deterioration data restoration unit 220 may obtain the luminance retention rate for each position of the pixel unit 110 by comparing the previous luminance before deterioration of the blocks BLK proceeds with the measured current luminance.

The deterioration data restoration unit 220 may calculate the deterioration value AGE of each of the blocks BLK from the current luminance retention rate of each of the blocks BLK using the first look-up table LUT1. The deterioration data restoration unit 220 may calculate the deterioration values AGE for all blocks BLK.

Thereafter, the second image data DATA2 may be generated by compensating for the first image data DATA1 based on the deterioration data DATA_A (S40).

When the read deterioration data DATA_A is determined to be normal, the deterioration data controller 210 may load the deterioration data DATA_A into the second storage unit 230. In addition, when the deterioration data DATA_A is restored by the deterioration data restoration unit 220, the deterioration data controller 210 may load restored deterioration data DATA_A' into the second storage unit 230. The second storage unit 230 may be implemented as a volatile memory device such as a dynamic random access memory (DRAM), a static random access memory (SRAM), mobile DRAM, or the like.

The deterioration data controller 210 may update the deterioration data DATA_A stored in the second storage unit 230. For example, the deterioration data controller 210 may update the deterioration data DATA_A stored in the second storage unit 230 by accumulating grayscale values for the blocks BLK included in the first image data DATA1 over time.

The deterioration data controller 210 may store the deterioration data DATA_A stored in the second storage unit 230 in the first storage unit 150.

The compensator 240 may generate the second image data DATA2 by compensating for the first image data DATA1 using the deterioration data DATA_A stored in the second storage unit 230. In an embodiment, the compensator 240 may read the deterioration values AGE of the blocks BLK from the deterioration data DATA_A stored in the second storage unit 230, and generate the second image data DATA2 using a predetermined second look-up table LUT2. The second look-up table LUT2 may include the compensation amount according to the deterioration value AGE.

According to an embodiment of the present invention, updating the deterioration data (S31) and storing the updated deterioration data in the first storage unit (S32) may be further included between the restoring the damaged deterioration data (S30) and the generating the second image data by compensating for the first image data (S40).

Like the deterioration data DATA_A that has not been damaged, the deterioration data controller 210 may update the restored deterioration data DATA_A' in real time from a restoration time point, and periodically store the restored deterioration data DATA_A' in the first storage unit 150. That is, as long as an error does not occur in the first storage unit 150, the deterioration data controller 210 does not need to request the deterioration data restoration unit 220 for additional restoration of the restored deterioration data DATA_A'.

As described above, the deterioration data controller 210 may determine whether the deterioration data DATA_A stored in the first storage unit 150 is abnormal, and when the deterioration data DATA_A is determined to be abnormal, the deterioration data controller 210 may control the deterioration data restoration unit 220 to restore the deterioration data DATA_A. Therefore, even if the deterioration data DATA_A stored in the first storage unit 150 is damaged, the deterioration data controller 210 may detect and restore this to normally compensate for the first image data DATA1. Accordingly, the afterimage may be prevented from occurring in the second image data DATA2.

The display device according to the embodiments of the present invention may determine whether the deterioration data stored in the nonvolatile memory is normal, and restore the deterioration data to compensate for the afterimage when the deterioration data is determined to be abnormal.

However, effects according to the present invention are not limited to the above-described effects, and may be variously extended without departing from the spirit and scope of the present invention.

The embodiments of the present invention have been described above with reference to the drawings. However, those skilled in the art to which the present invention pertains will appreciate that various modifications and changes can be made to the present invention without departing from the spirit and scope of the present invention described in the following claims.

What is claimed is:

1. A display device comprising:

a pixel unit including blocks, the blocks each including at least one pixel;

a first storage unit which stores deterioration data including deterioration values, the deterioration values each representing a degree of deterioration of each of the blocks;

a deterioration compensator including a compensator which generates second image data by compensating for first image data based on the deterioration data;

a data driver which generates data signals based on the second image data and supplies the data signals to the pixel unit; and a sensing unit which receives a sensing signal corresponding to the data signals from the pixel unit and calculates sensing data based on the sensing signal, wherein the deterioration compensator further includes:

a deterioration data controller which determines whether the deterioration data is abnormal by comparing a size of a first deterioration value of a first block with sizes of adjacent deterioration values of adjacent blocks adjacent to the first block; and a deterioration data restoration unit which restores the deterioration data based on a look-up table in which a luminance retention rate according to the degree of deterioration is set and the sensing data, when the deterioration data is determined to be abnormal, wherein the blocks include the first and adjacent blocks, and the deterioration values stored in the first storage unit include the first and adjacent deterioration values.

2. The display device of claim 1, wherein the deterioration data controller determines that the deterioration data is abnormal, when a value obtained by dividing the first deterioration value by a minimum value among the adjacent deterioration values is greater than a predetermined threshold value except for a case that the minimum value is zero, or a value obtained by dividing a maximum value among the adjacent deterioration values by the first deterioration value is greater than the predetermined threshold value.

3. The display device of claim 1, wherein the look-up table stores the deterioration values having 4 size intervals from 0 to 1024, and wherein the deterioration data restoration unit calculates a deterioration value that is not stored in the look-up table through a linear interpolation operation.

4. The display device of claim 1, wherein the sensing data includes the luminance retention rate of each of the blocks, and wherein the luminance retention rate is a quantity obtained by comparing a current luminance of each of the blocks with a previous luminance of each of the blocks before deterioration of the blocks proceeds.

5. The display device of claim 4, wherein the deterioration data restoration unit updates the deterioration values of all the blocks based on the look-up table and the luminance retention rate included in the sensing data, and calculates restored deterioration data corresponding to the updated deterioration values.

6. The display device of claim 5, further comprising:

a second storage unit which stores the restored deterioration data, wherein the first storage unit is implemented as a non-volatile memory, and the second storage unit is implemented as a volatile memory.

7. The display device of claim 6, wherein the deterioration data controller accumulates grayscale values for the blocks included in the first image data in the restored deterioration data over time to update the restored deterioration data in real time from a restoration time point, and periodically stores updated restored deterioration data in the first storage unit.

8. A display device comprising:

a pixel unit including blocks, the blocks each including at least one pixel;

a first storage unit which stores deterioration data including deterioration values, the deterioration values each representing a degree of deterioration of each of the blocks;

a deterioration compensator including a compensator which generates second image data by compensating for first image data based on the deterioration data; and a data driver which generates data signals based on the second image data and supplies the data signals to the pixel unit, wherein deterioration compensator further includes:

a deterioration data controller which determines whether the deterioration data is abnormal by comparing a size of a first deterioration value of a first block with sizes of adjacent deterioration values of adjacent blocks adjacent to the first block; and a deterioration data restoration unit which restores the deterioration data based on a look-up table in which a luminance retention rate according to the degree of deterioration is set and captured image data provided from outside, when the deterioration data is determined to be abnormal, wherein the blocks include the first and adjacent blocks, and the deterioration values stored in the first storage unit include the first and adjacent deterioration values.

9. The display device of claim 8, wherein the deterioration data controller determines that the deterioration data is abnormal when a value obtained by dividing the first deterioration value by a minimum value among the adjacent deterioration values is greater than a predetermined threshold value except for a case that the minimum value is zero, or a value obtained by dividing a maximum value among the adjacent deterioration values by the first deterioration value is greater than the predetermined threshold value.

10. The display device of claim 8, wherein the look-up table stores the deterioration values having 4 size intervals from 0 to 1024, and wherein the deterioration data restoration unit calculates a deterioration value that is not stored in the look-up table through a linear interpolation operation.

11. The display device of claim 8, wherein the captured image data includes a current luminance of each of the blocks of the pixel unit obtained by an imaging device.

12. The display device of claim 11, wherein the deterioration data restoration unit compares the current luminance with a previous luminance of each of the blocks before deterioration of the blocks proceeds to obtain the luminance retention rate for the each of the blocks of the pixel unit.

13. The display device of claim 12, wherein the deterioration data restoration unit updates the deterioration values of all the blocks based on the look-up table and the luminance retention rate obtained by the deterioration data restoration unit, and calculates restored deterioration data corresponding to the updated deterioration values.

14. The display device of claim 13, further comprising:

a second storage unit which stores the restored deterioration data, wherein the first storage unit is implemented as a non-volatile memory, and the second storage unit is implemented as a volatile memory.

15. The display device of claim 14, wherein the deterioration data controller accumulates grayscale values for the blocks included in the first image data in the restored deterioration data over time to update the restored deterioration data in real time from a restoration time point, and periodically stores updated restored deterioration data in the first storage unit.

16. A method for restoring deterioration data of a display device, comprising:

reading deterioration data from a first storage unit;

determining whether the deterioration data is abnormal by comparing a size of a first deterioration value of a first block with sizes of adjacent deterioration values of adjacent blocks adjacent to the first block;

restoring the deterioration data based on a look-up table in which a luminance retention rate according to a degree of deterioration is set and sensing data provided from a sensing unit, when the deterioration data is determined to be abnormal; and generating second image data by compensating for first image data based on the restored deterioration data, wherein the display device includes blocks each including at least one pixel, the blocks include the first and adjacent blocks, the deterioration data includes deterioration values each representing a degree of deterioration of each of the blocks, and the deterioration values include the first and adjacent deterioration values.

17. The method of claim 16, wherein in the determining whether the deterioration data is abnormal, when a value obtained by dividing the first deterioration value by a minimum value among the adjacent deterioration values is greater than a predetermined threshold value except for a case that the minimum value is zero, or a value obtained by dividing a maximum value among the adjacent deterioration values by the first deterioration value is greater than the predetermined threshold value, the deterioration data is determined to be abnormal.

18. The method of claim 16, wherein the look-up table stores the deterioration values having 4 size intervals from 0 to 1024, and wherein the restoring of the deterioration data includes:

calculating a deterioration value that is not stored in the look-up table through a linear interpolation operation.

19. The method of claim 16, wherein the display device includes a pixel unit including the blocks, wherein the sensing data includes the luminance retention rate of each of the blocks, and wherein the luminance retention rate is a quantity obtained by comparing a current luminance of each of the blocks with a previous luminance of each of the blocks before deterioration of the blocks proceeds.

20. The method of claim 19, wherein the restoring of the deterioration data includes:

updating the deterioration values of all the blocks based on the look-up table and the luminance retention rate included in the sensing data; and calculating restored deterioration data corresponding to the updated deterioration values.

* * * * *